US011247472B2

(12) United States Patent
Umeda

(10) Patent No.: US 11,247,472 B2
(45) Date of Patent: Feb. 15, 2022

(54) CLEANING APPARATUS, INKJET IMAGE FORMING APPARATUS, AND CLEANING METHOD

(71) Applicant: Konica Minolta Inc., Tokyo (JP)

(72) Inventor: Katsuhiro Umeda, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/897,741

(22) Filed: Jun. 10, 2020

(65) Prior Publication Data

US 2020/0391513 A1 Dec. 17, 2020

(30) Foreign Application Priority Data

Jun. 11, 2019 (JP) ..... JP2019-108799

(51) Int. Cl.
*B41J 2/165* (2006.01)

(52) U.S. Cl.
CPC .. *B41J 2/16538* (2013.01); *B41J 2002/16573* (2013.01)

(58) Field of Classification Search
CPC ..... B41J 2/16538; B41J 2002/16573; B41J 2002/012; B41J 29/17
See application file for complete search history.

(56) References Cited

U.S. PATENT DOCUMENTS

2009/0073222 A1* 3/2009 Hori ..... B41J 2/01 347/33
2009/0317555 A1* 12/2009 Hori ..... B41J 29/393 427/428.06

FOREIGN PATENT DOCUMENTS

JP 2007190913 A 8/2007
JP 200905118 A 3/2009

* cited by examiner

*Primary Examiner* — Sharon Polk
(74) *Attorney, Agent, or Firm* — Cantor Colburn LLP

(57) ABSTRACT

A cleaning apparatus carries ink ejected from an inkjet head and cleans a transfer body that transfers the ink onto a recording medium at a transfer nip, and the cleaning apparatus includes: a cleaning rotor that contacts the transfer body and rotates in a counter direction opposite to a moving direction of the transfer body to remove a pre-coating agent and an impurity present on the transfer body after transfer.

13 Claims, 10 Drawing Sheets

FIG. 10

| MATERIAL OF ROLLER | SURFACE ENERGY [mN/m] |
|---|---|
| COPPER | 1100 |
| STAINLESS STEEL | 700 TO 1100 |
| ALUMINUM | 800 |
| PI | 50 |
| PET | 43.8 |
| PP | 29 |
| PFA | 18 |

FIG. 11

| PRE-COATING AGENT | SURFACE ENERGY [mN/m] |
|---|---|
| POLYETHYLENE GLYCOL | 45.7 |
| LIQUID PARAFFIN | 31.2 |
| SILICONE OIL | 19 |
| OLIVE OIL | 31.6 |

FIG. 12

| | PAPER TYPE | PRE-COATING AGENT | BASE MATERIAL | MATERIAL OF ROLLER (SURFACE) | ROTATIONAL DIRECTION | ROTATIONAL SPEED RATIO | CLEANING PERFORMANCE |
|---|---|---|---|---|---|---|---|
| EXAMPLE 1 | HIGH-QUALITY PAPER | PEG−200 | PI | PET | COUNTER | $\theta$ | ○ |
| EXAMPLE 2 | HIGH-QUALITY PAPER | PEG−200 | PI | ALUMINUM | COUNTER | $\theta$ | ◎ |
| EXAMPLE 3 | PET | SILICONE OIL | PP | PET | COUNTER | $\theta$ | ○ |
| EXAMPLE 4 | PET | SILICONE OIL | PP | PET | COUNTER | $\theta'$ | ◎ |
| COMPARATIVE EXAMPLE 1 | HIGH-QUALITY PAPER | NONE | PI | ALUMINUM | COUNTER | $\theta$ | × |
| COMPARATIVE EXAMPLE 2 | HIGH-QUALITY PAPER | PEG−200 | PI | ALUMINUM | WIDTH | $\theta$ | × |

CLEANING APPARATUS, INKJET IMAGE FORMING APPARATUS, AND CLEANING METHOD

CROSS REFERENCE TO RELATED APPLICATIONS

The present invention claims priority under 35 U.S.C. § 119 to Japanese patent Application No. 2019-108799, filed on Jun. 11, 2019, the entire content of which is incorporated herein by reference.

BACKGROUND

Technological Field

The present invention relates to a cleaning apparatus, an inkjet image forming apparatus, and a cleaning method.

Description of the Related Art

In recent years, an image forming apparatus for inkjet printing (hereinafter, referred to as an inkjet image forming apparatus) has been widely used as an apparatus that records a high-definition image on various recording media such as paper and fabric.

In recent years, in order to reduce the cost, the inkjet image forming apparatus has been demanded to suppress an ink ejection amount from an inkjet head and thus an ink adhesion amount to a recording medium as much as possible. However, reducing the ink adhesion amount has a problem that a contrast ratio is decreased, and unevenness occurs in solid image printing.

For this problem, if a spherical droplet ejected from the inkjet head can be flattened (spread) on the recording medium, the decrease in the contrast ratio can be resolved. On the other hand, when such a method is adopted, ink bleeding might possibly occur on the recording medium depending on the ink viscosity (especially when the ink viscosity is low).

In order to cope with the above problem, an inkjet image forming apparatus with an intermediate transfer system has been proposed, in which an image formed by ink ejected from an inkjet head is once carried on an intermediate transfer body such as a transfer belt, and the image is transferred onto a recording medium, (see, for example, JP 2009-51118 A). According to such an inkjet image forming apparatus with an intermediate transfer system, the ink can be spread on the intermediate transfer body without bleeding. Thus, it is possible to print a solid image smoothly spread on the recording medium while suppressing the ink ejection amount from the inkjet head.

Moreover, to enhance transfer efficiency and improve cleanability in an inkjet image forming apparatus with an intermediate transfer system, there has been devised a system in which a pre-coating agent is supplied to an intermediate transfer body (hereinafter, referred to as a "transfer body"), and an image is formed thereon to be transferred (see, for example, JP 2009-51118 A or JP 2007-190913).

Incidentally, in the inkjet image forming apparatus with the above system, it is necessary to remove the pre-coating agent and various impurities (e.g., residual ink and dust) remaining on the transfer body after the ink on the transfer body has been transferred onto the recording medium before the next printing.

SUMMARY

An object of the present invention is to provide a cleaning apparatus, an inkjet image forming apparatus, and a cleaning method, which can improve the performance of removing impurities left on a transfer body.

To achieve the abovementioned object, according to an aspect of the present invention, there is provided a cleaning apparatus that carries ink ejected from an inkjet head and cleans a transfer body that transfers the ink onto a recording medium at a transfer nip, and the cleaning apparatus reflecting one aspect of the present invention comprises: a cleaning rotor that contacts the transfer body and rotates in a counter direction opposite to a moving direction of the transfer body to remove a pre-coating agent and an impurity present on the transfer body after transfer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 10 is a table showing specific examples of the material used for the cleaning roller or the transfer belt and comparing the surface energies thereof;

FIG. 11 is a table showing the types of pre-coating agent and comparing the surface energies thereof; and FIG. 12 is a list summarizing the results of various experimental examples.

DETAILED DESCRIPTION OF EMBODIMENTS

Figure 1:
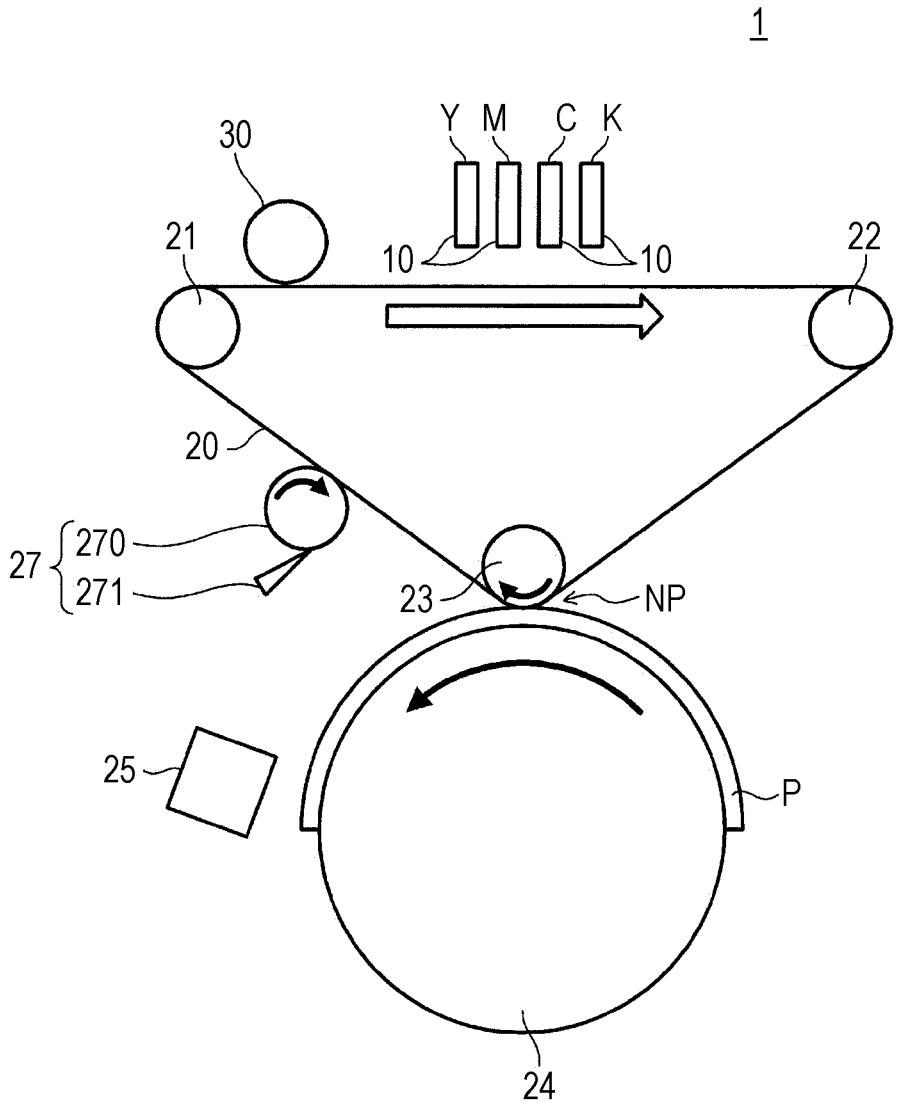
FIG. 1 is a schematic configuration diagram of an inkjet image forming apparatus according to an embodiment.
Figure 2:
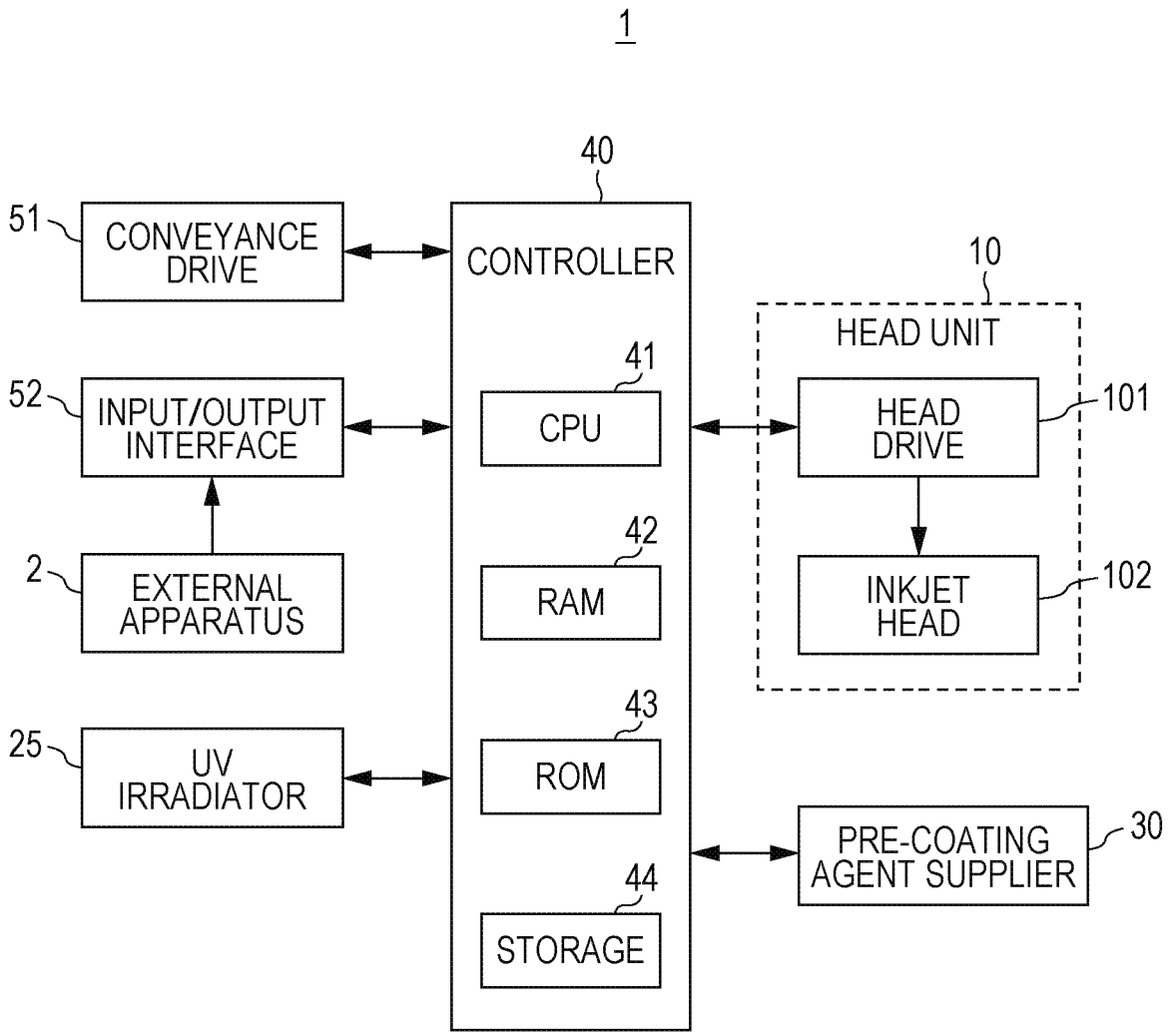
FIG. 2 is a block diagram showing the main functional configuration of the inkjet image forming apparatus in FIG. 1.

Hereinafter, an inkjet image forming apparatus according to one or more embodiments of the present embodiment will be described in detail with reference to the drawings. However, the scope of the invention is not limited to the disclosed embodiments. FIG. 1 is a diagram showing the schematic configuration of an inkjet image forming apparatus 1 according to the present embodiment. In addition, FIG. 2 is a block diagram showing the main functional configuration of the inkjet image forming apparatus 1.

The inkjet image forming apparatus 1 includes: head units 10 on which inkjet heads 102 (see FIG. 2) are mounted; a transfer belt 20 serving as an image carrier or a transfer body; driven rollers 21 and 22 and a transfer roller 23 serving as a driving roller, which rotatably stretch the transfer belt 20; a conveyance drum 24 that conveys a recording medium P; and a controller 40 (see FIG. 2) that controls the entire apparatus.

The inkjet image forming apparatus 1 further includes: a pre-coating agent supplier 30 that supplies a pre-coating agent to the transfer belt 20 prior to image formation (ink ejection); a UV irradiator 25 that cures ink transferred from the transfer belt 20 onto the recording medium P; a cleaner 27 that cleans the transfer belt 20; and a conveyance drive 51 (see FIG. 2) that drives each unit including the transfer roller 23, the conveyance drum 24 and the like.

Note that, although not shown, the inkjet image forming apparatus 1 includes: a feeder that loads the recording medium P and feeds the recording medium P to the conveyance drum 24; a discharger that discharges the recording medium P, on which the image has been transferred, to a downstream side of the conveyance drum 24 in the conveyance direction; a display that displays the status of the apparatus; and the like. Since these are known constituents, the illustration and description thereof are omitted.

As the recording medium P, various media that can fix the ink landed on the surface, such as fabric and sheet-shaped resin, can be used besides paper such as plain paper or coated paper.

The transfer belt 20 is stretched over the driven rollers 21 and 22 disposed above and the transfer roller 23 disposed below, and the driving force of a transfer motor (not shown) of the conveyance drive 51 is transmitted to the transfer roller 23, thereby rotating the transfer belt 20 clockwise in FIG. 1.

As a specific example, the transfer belt 20 is an endless belt in which an elastic layer of silicone rubber and a surface layer of polyimide (PI) are laminated on a base material of polyimide (PI). Moreover, as a specific example of the transfer roller 23, a rubber roller with a diameter of 100 mm and a rubber thickness of the surface layer of 10 mm is used.

The aforementioned transfer motor is driven based on a control signal from the controller 40, and the transfer roller 23 rotates clockwise in FIG. 1 so that the transfer belt 20 rotates clockwise (see the outline arrow in FIG. 1). In a specific example, under the control of the controller 40, the rotational speed of the transfer roller 23 is controlled so that the transfer belt 20 rotates at a speed (printing speed) of 600 mm/second.

The conveyance drum 24 rotates around a rotational shaft extending in a direction perpendicular to the drawing of FIG. 1 (hereinafter, referred to as an "orthogonal direction") in a state of holding the recording medium P on a peripheral curved surface (conveyance surface) with a cylindrical surface shape to convey the recording medium P along the conveyance surface along the conveyance direction. Specifically, the conveyance drum 24 includes a conveyance drum motor (not shown) and rotates counterclockwise in FIG. 1 by driving the motor under the control of the controller 40. In a specific example, a large (e.g., a triple cylinder for a printing machine) metal drum is used for the conveyance drum 24.

In a specific example, the transfer belt 20, the transfer roller 23, and the conveyance drum 24, which are described above, have a width of 800 mm, that is, a length in the axial direction.

The transfer roller 23 is disposed to oppose the upper portion of the conveyance drum 24 and pressurizes the conveyance drum 24 via the transfer belt 20. Moreover, the conveyance drum 24 is pressed against the transfer roller 23 with the transfer belt 20 interposed there between, thereby forming a transfer nip NP that transfers an ink image from the transfer belt 20 onto the recording medium P. The transfer nip NP functions as a "transfer unit" in the inkjet image forming apparatus 1.

In a specific example, the initial value of the weight or pressure contact force (hereinafter, referred to as "transfer pressure") at the transfer nip NP is set to 80 N. Furthermore, the transfer pressure can be changed by the transfer roller 23 slightly moving in the vertical direction in FIG. 1 under the control of the controller 40. In a specific example, the shaft of the transfer roller 23 is connected to a solenoid or the like (not shown) of the conveyance drive 51, and the solenoid or the like is driven under the control of the controller 40 so that the shaft of the transfer roller 23 can be slightly moved downward or upward in FIG. 1 to change the transfer pressure to a value higher or lower than 80 N.

The head units 10 eject inks onto the transfer belt 20 from nozzle openings provided on ink ejection surfaces (also referred to as nozzle surfaces) opposing the transfer belt 20 and causes the transfer belt 20 to carry an image. The conveyance drum 24 conveys the recording medium P so that the image carried on the transfer belt 20 is transferred onto a predetermined position of the recording medium P by the transfer nip NP.

In the inkjet image forming apparatus 1 according to the present embodiment, four head units 10 for respective four colors of inks, which are yellow (Y), magenta (M), cyan (C) and black (K), are arranged so as to be aligned at predetermined intervals in the order of Y, M, C and K from the upstream side of the transfer belt 20 in the rotational direction.

Each head unit 10 includes the inkjet head 102 (see FIG. 2). The inkjet head 102 is provided with a plurality of recording elements, each having a pressure chamber for storing ink, a piezoelectric element provided on a wall surface of the pressure chamber, and a nozzle. When a driving signal for deforming the piezoelectric element is inputted into the recording element, the pressure chamber is deformed by the deformation of the piezoelectric element, the pressure in the pressure chamber is changed, and the ink is ejected from the nozzle communicating with the pressure chamber.

The disposition range of the nozzles included in the inkjet head 102 in the orthogonal direction covers the width of a region, which is in the orthogonal direction and where an image is recorded in the recording medium P conveyed by the conveyance drum 24. The head unit 10 is used with the position thereof fixed with respect to the rotational shaft of the conveyance drum 24 during image recording. That is, the inkjet image forming apparatus 1 is a single-pass inkjet image forming apparatus.

In this example, as the ink ejected from the inkjet head 102 onto the transfer belt 20, ink whose viscosity changes depending on the amount of supplied energy (in this example, the quantity of ultraviolet (UV) light outputted from the UV irradiator 25) is used. Specifically, ink with the property is used, in which the viscosity increases as the quantity of ultraviolet light emitted from the UV irradiator 25 increases. That is, an image forming unit of the inkjet image forming apparatus 1 employs a UV-curable inkjet system.

The UV irradiator 25 is disposed so as to irradiate the recording medium P, which is conveyed to the downstream side of the transfer nip NP, with ultraviolet light (hereinafter, referred to as "UV light"). Under the control of the controller 40, the UV irradiator 25 plays a role of curing the ink which is on the recording medium P and transferred from the transfer belt 20 by the transfer nip NP. In a specific example, the UV irradiator 25 includes a UV light source that outputs UV light with a wavelength of 395 nm, and the default value of the irradiation intensity in a normal print job is 5 $mW/cm^2$.

Note that, depending on the type of ink used, a UV irradiator (not shown) serving as a pre-curing unit that adjusts the viscosity of the ink ejected onto the transfer belt 20 may be added somewhere from the downstream side of the head unit 10 to the upstream side of the transfer nip NP in the conveyance direction.

The cleaner 27 is disposed to oppose the surface of the transfer belt 20 between the driven roller 21 and the transfer roller 23, and includes: a cleaning roller 270 that cleans the surface of the transfer belt 20; and a blade 271 that cleans the surface of the cleaning roller 270. The cleaning roller 270 of the cleaner 27 corresponds to a "rotor" of the present invention.

The cleaning roller 270 is enabled to be in and out of contact with the transfer belt 20 (see FIG. 7), is brought into contact with the transfer belt 20 to form a cleaning nip under the control of the controller 40, and cleans the surface of the transfer belt 20.

Moreover, under the control of the controller 40, the cleaning roller 270 rotates in a predetermined direction by transmitting the power of a driving motor that drives the cleaning roller 270. The details of the rotational operation will be described later.

In the present embodiment, the cleaner 27 and the controller 40 correspond to a "cleaning apparatus" of the present invention.

The pre-coating agent supplier 30 is disposed on the upstream side of the head unit 10 in the conveyance direction and supplies a pre-coating agent to the transfer belt 20 under the control of the controller 40. In a specific example, the pre-coating agent supplier 30 includes: an accommodation layer that accommodate a liquid pre-coating agent; a plurality of rollers that convey the pre-coating agent in the accommodation layer to the surface of the transfer belt 20 and apply (supply) the pre-coating agent to the surface; a motor that drives the rollers; and the like.

Note that the pre-coating agent supplier 30 is the same as a known one, and thus the illustration and detailed description of these portions will be omitted. However, the type and the like of the pre-coating agent used will be described later.

Next, other main functional constituents of the inkjet image forming apparatus 1 will be described mainly with reference to FIG. 2. The inkjet image forming apparatus 1 includes: a head drive 101 and the inkjet head 102 included in the head unit 10; the aforementioned pre-coating agent supplier 30; the controller 40; and a conveyance drive 51; and an input/output interface 52.

Based on the control of the controller 40, the head drive 101 outputs, to the recording elements of the inkjet head 102, a driving signal for deforming the piezoelectric elements in accordance with image data at appropriate timing, thereby causing the nozzles of the inkjet head 102 to eject ink with an amount corresponding to the pixel values of the image data.

The controller 40 has a central processing unit (CPU) 41, a random access memory (RAM) 42, a read only memory (ROM) 43, and storage 44.

The CPU 41 reads out various control programs and setting data stored in the ROM 43, stores the programs and the data in the RAM 42, and executes the programs to perform various arithmetic processings. The CPU 41 also performs integrated control over the overall operation of the inkjet image forming apparatus 1.

The RAM 42 provides a working memory space to the CPU 41 and stores temporary data. Note that the RAM 42 may include a nonvolatile memory.

The ROM 43 stores various control programs executed by the CPU 41, the setting data, and the like. Note that a rewritable nonvolatile memory, such as an electrically erasable programmable read only memory (EEPROM) or a flash memory, may be used instead of the ROM 43.

The storage 44 stores a print job (an image formation instruction including various user setting information (e.g., the number of prints)) and image data related to the print job inputted from an external apparatus 2 via an input/output interface 52. As the storage 44, for example, a hard disk drive (HDD) is used, and a dynamic random access memory (DRAM) or the like may be used in combination.

Based on a control signal supplied from the controller 40, the conveyance drive 51 supplies a driving signal to the conveyance drum motor of the conveyance drum 24 to rotate the conveyance drum 24 at a predetermined speed and timing. Based on a control signal supplied from the controller 40, the conveyance drive 51 also supplies a driving signal to the transfer motor that drives the transfer roller 23 to rotate the transfer belt 20 at a predetermined speed and timing.

Based on a control signal supplied from the controller 40, the pre-coating agent supplier 30 supplies a driving signal to the motor that drives the aforementioned rollers of the pre-coating agent supplier 30 to apply (supply) a predetermined amount of the pre-coating agent to the transfer belt 20 from the pre-coating agent supplier 30.

The input/output interface 52 mediates data transmission/reception between the external apparatus 2 and the controller 40. The input/output interface 52 is constituted by, for example, any of various serial interfaces and various parallel interfaces, or a combination thereof.

The external apparatus 2 is, for example, a personal computer and supplies a print job, image data, and the like to the controller 40 via the input/output interface 52.

Figure 3:
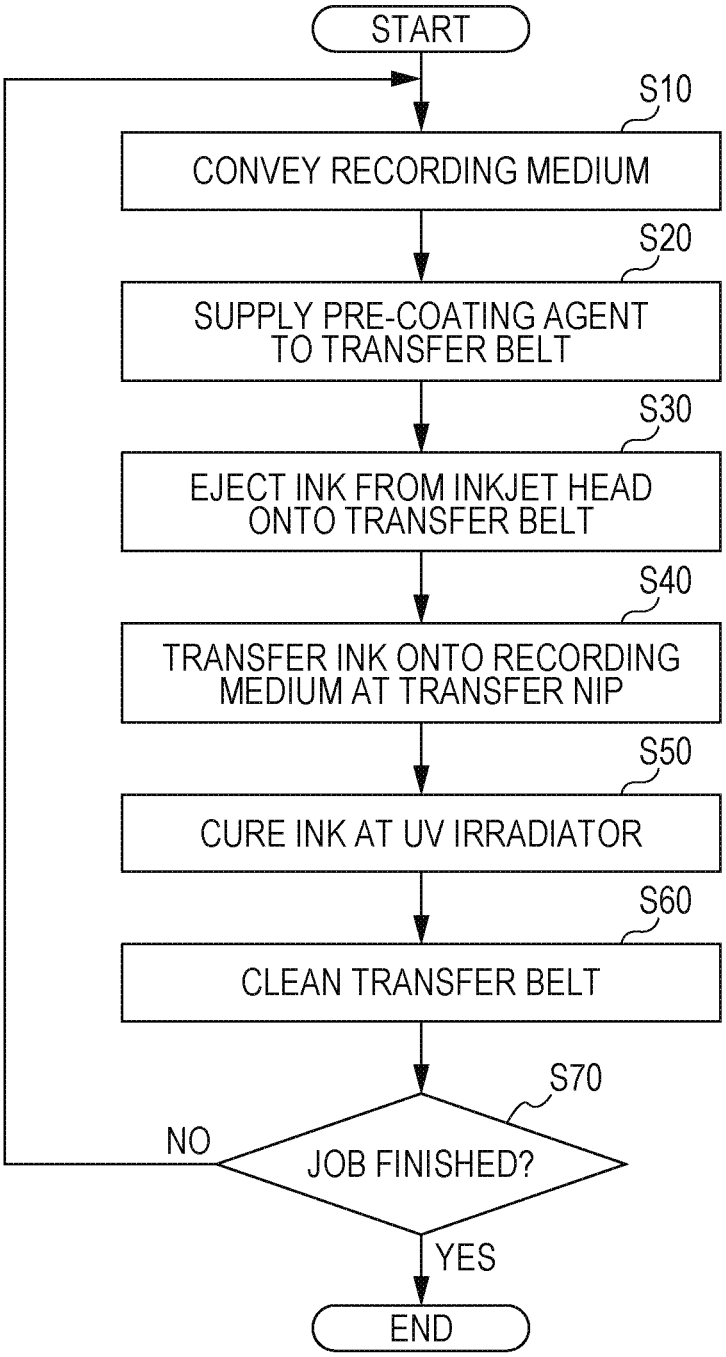
FIG. 3 is a flowchart for explaining the processings during normal print job execution.

Next, the processings executed by the controller 40 during normal print job execution will be described with reference to the flowchart in FIG. 3.

After receiving the print job, the image data, and the like, the controller 40 controls the conveyance drive 51 so as to drive the conveyance drum 24 and the transfer roller 23 to start conveying the recording medium P (Step S10).

Moreover, the controller 40 outputs a driving signal to the motor of the pre-coating agent supplier 30 to supply the pre-coating agent onto the transfer belt 20 and controls the conveyance drive 51 so as to rotate the transfer belt 20 at the aforementioned rotational speed (circumferential speed) (Step S20).

Subsequently, based on the received image data and user setting information, the controller 40 controls the head drive 101 to eject an ink onto the transfer belt 20 from the inkjet head 102 of the head unit 10 of the color used in the printing (image formation) (Step S30). By this operation, an image (ink image) based on the input image data is superimposedly adhered (carried) on the surface of the transfer belt 20 to which the pre-coating agent is adhered.

In Step S40, the controller 40 controls the conveyance drive 51 so as to convey the recording medium P to the transfer nip NP at predetermined timing so that the ink image carried on the transfer belt 20 is transferred onto the recording medium P. At this time, by pressing the ink image with a preset transfer pressure (sandwiching by the transfer nip NP), the ink image carried on the transfer belt 20 is transferred onto the recording medium P so as to entirely spread in accordance with the transfer pressure and the like.

In Step S50, the controller 40 controls the output of the UV irradiator 25 at the timing when the recording medium P onto which the ink image had been transferred comes to the position of the UV irradiator 25, thereby performing a step of curing or fixing the ink image. Thereafter, the recording medium P is discharged to a discharger (not shown).

In Step S60, the controller 40 outputs a driving signal to the driving motor of the cleaner 27 to execute processing of cleaning the transfer belt 20 by removing the pre-coating agent, the residual ink, and the like on the transfer belt 20. At this time, the cleaning apparatus moves the pre-coating agent, the residual ink, and the like on the transfer belt 20 to the cleaning roller 270 and further removes the pre-coating agent, the residual ink, and the like moved to the cleaning roller 270 by the blade 271 to carry out the cleaning.

In Step S70, the controller 40 determines whether or not the print job has finished. Herein, when the controller 40 has determined that the print job has not yet finished (NO in step S70), the controller 40 returns to Step S10 and repeatedly executes the processings of Steps S10 to S70 described above. On the other hand, when the controller 40 has determined that the print job has finished (Yes in S70), the controller 40 ends the series of processings.

Thus, the inkjet image forming apparatus with the an intermediate system has an advantage that the ink can be saved since the ink can be smoothly spread on the recording medium P without bleeding while the amount of ink ejected from the inkjet head 102 can be suppressed.

In addition, by supplying the pre-coating agent from the pre-coating agent supplier 30 to the transfer belt 20 before the ink is ejected, the supplied pre-coating agent acts as a release agent. Thus, the adhesion force of the ink and impurities to the transfer belt 20 can be reduced. Therefore, according to the system of supplying the pre-coating agent, it is possible to enhance the transfer efficiency at the transfer nip NP and to improve the subsequent cleanability as compared with a model that does not use the pre-coating agent.

Incidentally, in the inkjet image forming apparatus with the above system of supplying the pre-coating agent, it is necessary to remove the pre-coating agent and various impurities remaining on the transfer belt 20 after the ink has been transferred onto the recording medium P before the next printing.

Herein, various types of impurities left or adhered (existing) on the transfer belt 20 include dregs of ink that has not been transferred (residual ink), ink that has been formed into mist and re-adhered to the transfer belt 20, paper dust of the recording medium P, atmospheric dust, and the like.

Hereinafter, for simplicity, the pre-coating agent and various impurities remaining on the transfer belt 20 at the downstream side of the transfer nip NP are collectively referred to as "residues".

With respect to this, in a conventional cleaning apparatus and an inkjet image forming apparatus, it has not been always easy to remove well the residues, particularly the impurities mixed in the pre-coating agent, on the transfer belt 20, possibly adversely affecting the next image formation.

For example, the technique described in JP 2009-51118 A or JP 2007-190913 A proposes a configuration in which a blade holds back and removes a pre-coating agent and impurities when the pre-coating agent is used to reduce the adhesion force of the ink and the impurities to a transfer member.

However, in such a conventional technique, the residues held back by the blade unfortunately caused convection and went (entered) under the blade. Then, there has been a problem that, if the blade slips at that time, the residues containing impurities pass through the edge of the blade, and the impurities cannot be removed, affecting the next image formation.

Moreover, in the conventional technique of the inkjet image forming apparatus, when a cleaning roller is used, it has been common to bring the cleaning roller into contact with a transfer body in a direction (width) the same as the moving direction of the transfer body to clean (see, for example, JP 2009-51118 A).

However, when the cleaning roller is brought into contact with the transfer body in width in such a way, impurities enter a cleaning nip and adhere to the transfer belt 20. Thus, even when the surface of the cleaning roller is made of a material with high wettability (i.e., residues easily adhere), a phenomenon of so-called "parting" occurs at the exit of the cleaning nip, and the residues remain on the transfer belt 20 and could not have been completely removed.

Furthermore, when a pre-coating agent is used, it is important to define the relationship of wettability to the pre-coating agent, to appropriately control the amount of pre-coating agent entering the cleaning nip, and the like. If these are not performed, there is similarly a problem that impurities get into the cleaning nip.

The inventors conducted various experiments and the like in order to solve the above-described problems. As a result, the inventors have found out that, by rotating a cleaning rotor, which contacts a transfer body to clean the surface thereof in a counter direction opposite to a moving direction of an intermediate transfer body, a pre-coating agent and impurities left after the transfer can be removed well.

Thus, in the present embodiment, as shown in FIG. 1, the cleaning roller 270 is rotated in the counter direction opposite to the rotational direction (moving or conveyance direction) of the transfer belt 20 and brought into contact therewith. Herein, the cleaning roller 270 corresponds to a "cleaning rotor" of the present invention and forms a cleaning nip by being brought into contact with the transfer belt 20.

Then, by bringing the counter-rotated cleaning roller 270 into contact with the transfer belt 20 as shown in FIG. 1, it is possible to prevent or effectively suppress the impurities mixed in the pre-coating agent from passing through the cleaning nip.

Specifically, by rotating the cleaning roller 270 in the counter direction opposite to the moving direction of the transfer belt 20, the force (property) of transferring or adhering the residues, which adhere to the transfer belt 20, to the cleaning roller 270 can be enhanced. Then, the residues on the transfer belt 20 are scraped up together with the pre-coating agent by the counter-rotated cleaning roller 270 so that the impurities mixed in the pre-coating agent can be removed (cleaned) well from the transfer belt 20.

Figure 4:
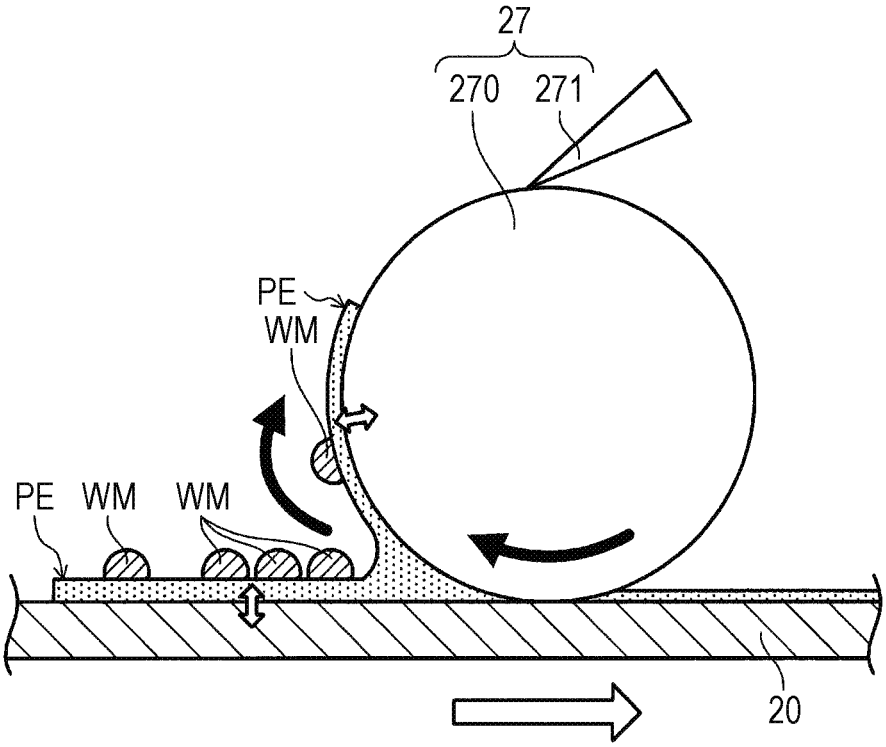
FIG. 4 is a diagram for explaining the operation principle of a cleaning apparatus according to an embodiment.

FIG. 4 is a diagram schematically showing the operation principle of the cleaning apparatus according to the present embodiment, where the reference sign PE denotes a pre-coating agent, and the reference numeral WM denotes impurities mixed in the pre-coating agent PE. Note that, for convenience of explanation, the angles from which FIG. 1 and FIG. 4 are shown are different. FIG. 4 shows the transfer belt 20 on the lower side and the cleaning roller 270 on the upper side. The same applies to FIG. 5A to FIG. 8.

As shown by the black arrows in FIG. 1 and FIG. 4, the operation is performed in the present embodiment, in which the cleaning roller 270 is counter-rotated and brought into contact with the transfer belt 20 in the moving direction (see the outline arrows in the respective drawings). With such operation, the following effects and advantages can be obtained.

(1) The pre-coating agent PE placed on the transfer belt 20 is held back by the cleaning roller 270 rotating in the counter direction. At this time, the impurities WM such as residual ink and dust not transferred at the transfer nip NP are also held back together. Thus, it is possible to effectively prevent or suppress the impurities WM from entering the cleaning nip where the cleaning roller 270 and the transfer belt 20 are in contact.

(2) As shown in FIG. 4, the pre-coating agent PE and the impurities WM held back by the cleaning roller 270 adhere to the cleaning roller 270 and are moved to the tip of the blade 271 which contacts the cleaning roller 270.

Note that the surface energy of the cleaning roller 270 should be greater than the surface energy of the transfer belt 20 from the viewpoint of performing this operation highly efficiently. In other words, if the surface energy of the cleaning roller 270 is too low, the pre-coating agent PE and the impurities WM will not easily adhere to the cleaning roller 270.

(3) The pre-coating agent PE and the impurities WM adhered to the cleaning roller 270 are scraped out of the surface of the cleaning roller 270 by the blade 271 and removed to the outside.

Herein, the blade 271 corresponds to a "removing member" of the present invention, and a doctor blade or the like with a width substantially the same as the axial width of the cleaning roller 270 can be used. Moreover, in this configuration example, since the residues scraped off by the blade 271 fall down (see also FIG. 9), a container or the like (not shown) for accommodating or collecting the dropped residues should be provided below the cleaning roller 270 and the blade 271.

By the above series of operations (1) to (3), the impurities WM such as residual ink and dust adhered on the transfer belt 20 adhere to the cleaning roller 270 together with the pre-coating agent PE, conveyed and removed from the surface of the cleaning roller 270 by the blade 271.

Note that it has been found that the optimum value of the rotational speed for rotationally driving the cleaning roller 270 in the counter direction changes mainly depending on the type of the recording medium P, that is, the absorbability of the pre-coating agent PE in the recording medium P.

Figure 5A:
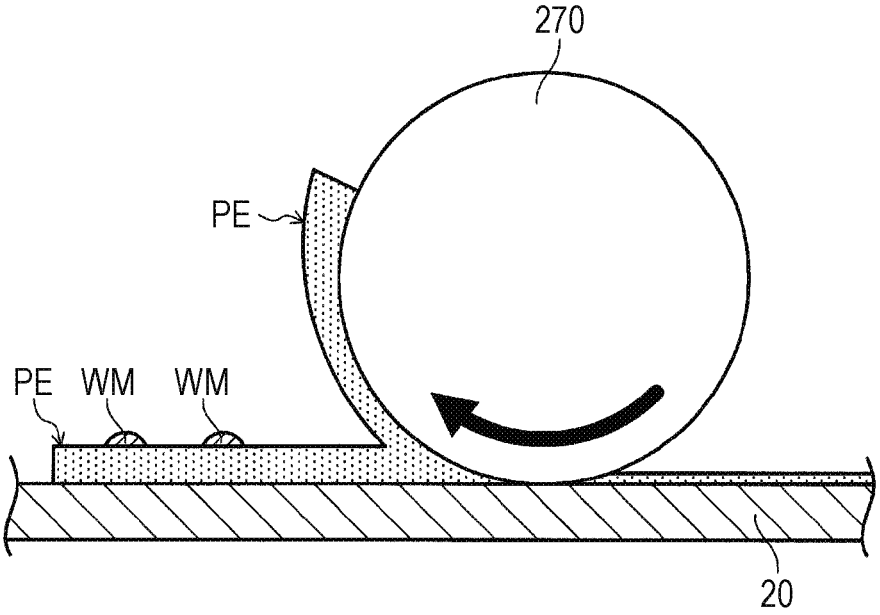
FIG. 5A and FIG. 5B are diagrams for explaining examples of controlling the rotational speed of a cleaning roller depending on the type of recording medium.
Figure 5B:
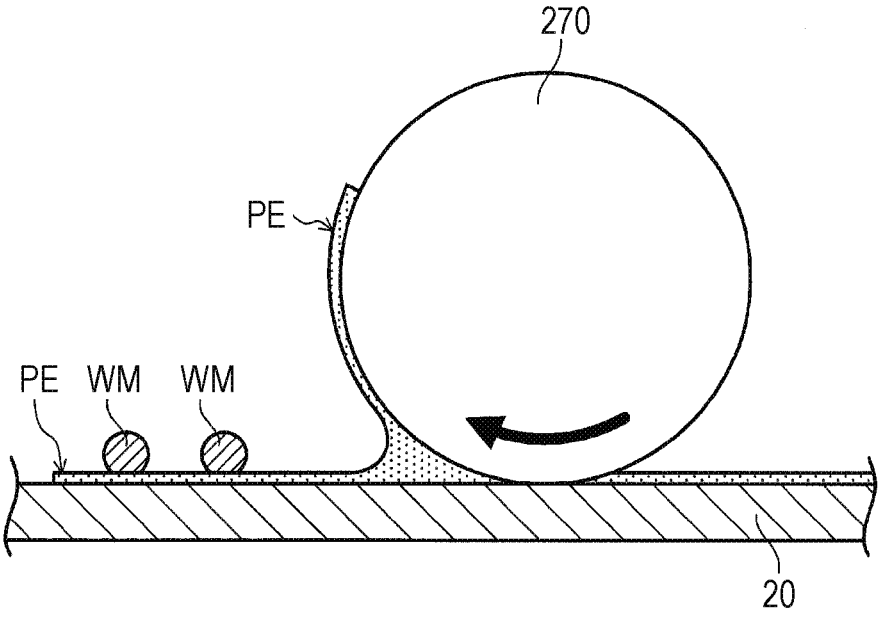

FIG. 5A and FIG. 5B are diagrams schematically showing an example of controlling the rotational speed of the cleaning roller 270 depending on the type of the recording medium P (absorbability of the pre-coating agent PE).

Herein, FIG. 5A schematically shows a state on the transfer belt 20 after the transfer when the recording medium P used at the time of printing is a non-absorbent sheet. In this case, the pre-coating agent PE is not absorbed by the recording medium P passing through the transfer nip NP. Thus, it is considered that a large amount of the pre-coating agent PE surges to the cleaning roller 270 (cleaning nip) as shown in FIG. 5A. Then, if this state is left as it is, the amount of liquid held back by the cleaning nip continues to increase (see also the outline double-headed arrow in FIG. 4), and the impurities WM may possibly eventually enter the cleaning nip.

In light of such circumstances, in the present embodiment, the controller 40 controls to change the rotational speed of the cleaning roller 270 (cleaning rotor) depending on the degree of absorbing the pre-coating agent PE by the recording medium P used. That is, the controller 40 increases the rotational speed of the cleaning roller 270 when the absorbability of the pre-coating agent PE in the recording medium P is low, as compared with the case where the absorbability of the pre-coating agent PE is high.

At this time, more pre-coating agent PE can be scraped up by the cleaning roller 270 whose rotational speed in the counter direction has increased. As a result, the impurities WM mixed in the pre-coating agent PE scraped up can be well separated (removed or cleaned) from the transfer belt 20.

Herein, the high/low absorbability of the pre-coating agent PE can be estimated mainly by the paper type of the recording medium P. Accordingly, the controller 40 controls to increase (run up) the number of rotations of the cleaning roller 270 depending on the paper type of the recording medium P used for printing, that is, when the paper type is one that does not absorb the pre-coating agent PE.

On the other hand, FIG. 5B schematically shows a state on the transfer belt 20 after the transfer when the recording medium P used for printing is a highly absorbent sheet. In this case, the pre-coating agent PE is absorbed by the recording medium P at the transfer nip NP. Thus, the amount (liquid level) of the pre-coating agent PE reaching the cleaning nip decreases as shown in FIG. 5B (see also the outline double-headed arrow shown in FIG. 4).

On the other hand, when the liquid level of the pre-coating agent PE reaching the cleaning nip decreases, there is a possibility that the impurities WM are not scraped up by the cleaning roller 270 and enter the cleaning nip while adhered to the transfer belt 20. The reason considered is that, when the liquid level of the pre-coating agent PE decreases, the release action of the pre-coating agent PE decreases, and the adhesion force of the impurities WM to the transfer belt 20 relatively increases.

Therefore, in the present embodiment, when the paper type of the recording medium P is a highly absorbent sheet, the controller 40 controls to reduce (lower) the rotational speed of the cleaning roller 270 (see the thin black arrow in FIG. 5B and the black arrow in FIG. 5A). With such control, it is possible to secure the liquid amount of the pre-coating agent PE held back by the cleaning nip between the transfer belt 20 and the cleaning roller 270 whose rotational speed in the counter direction has been lowered.

That is, the pre-coating agent PE is accumulated right before the cleaning nip to increase the liquid level thereof with the above control, thereby securing the release action of the pre-coating agent PE and weakening the adhesion force of the impurities WM to the transfer belt 20. Then, by the rotation of the cleaning roller 270 in the counter direction, the accumulated pre-coating agent PE as well as the impurities WM can be effectively scraped up.

By controlling to adjusting the number of rotations of the cleaning roller 270 depending on the paper type of the recording medium P passing through the transfer nip NP, suitable cleaning can be realized in consideration of the large/small amount of the pre-coating agent PE reaching the cleaning nip.

Figure 6A:
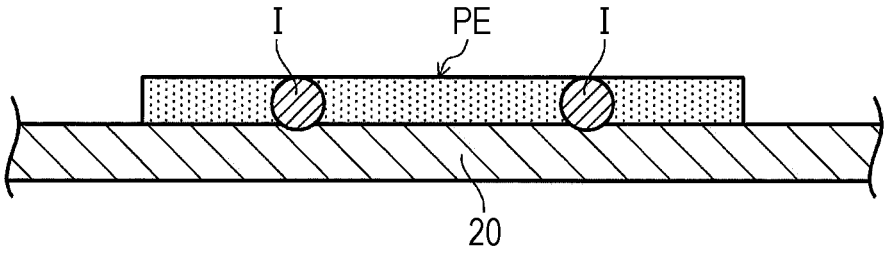
FIG. 6A and FIG. 6B are diagrams for explaining the relationship between the surface energy of a pre-coating agent and the surface energy of an ink.
Figure 6B:
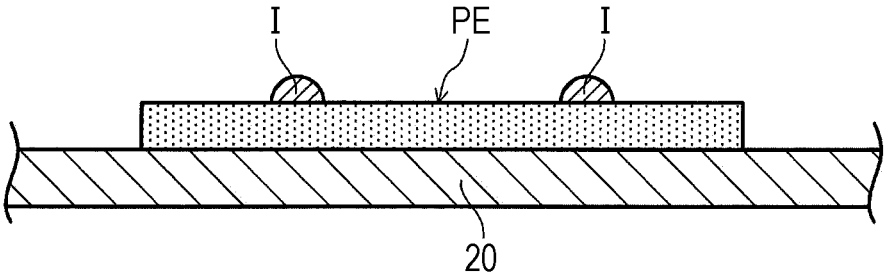

Next, the relationship between the surface energy of the pre-coating agent PE and the surface energy of the ink will be described. FIG. 6A and FIG. 6B are diagrams for explaining the relationship between the surface energy of the pre-coating agent PE and the surface energy of an ink I.

Herein, FIG. 6A schematically shows a state on the transfer belt 20 before the transfer when the surface energy of the pre-coating agent PE is lower than the surface energy of the ink I. In this case, as shown in FIG. 6A, the ink I ejected from the inkjet head 102 sinks into the pre-coating agent PE on the transfer belt 20 and adheres to the transfer belt 20. Thus, the transferability to the recording medium P at the transfer nip NP and the subsequent cleanability are deteriorated.

On the other hand, when the surface energy of the pre-coating agent PE is higher than the surface energy of the ink I, the ejected ink I can stay on the pre-coating agent PE as shown in FIG. 6B. As a result, it is possible to transfer the ink I and clean the downstream side.

Therefore, in the present embodiment, the following relationship is secured for these surface energies (wettabilities).

Surface Energy of Pre-Coating Agent PE>Surface Energy of Ink I

Note that the pre-coating agent PE and the ink I are generally not supplied to the transfer belt 20 when an image is not formed, such as when the inkjet image forming apparatus 1 is activated or idled. Then, when the counter-rotated cleaning roller 270 is brought into contact with the transfer belt 20 in such a state, the durabilities of the surfaces of the cleaning roller 270 and the transfer belt 20 as well as the durability of driving sources (motors or the like) of these members may be possibly reduced.

Thus, the controller 40 controls to bring the counter-rotated cleaning roller 270 into contact with the transfer belt 20 when the transfer belt 20 carries the pre-coating agent PE and the ink I, that is, when an image is formed, such as when the print job is executed or when a test image is printed.

On the other hand, when an image is not formed and the pre-coating agent PE and the like are not supplied as described above, it is desirable that the controller 40 control to reduce the cleaning performance by the cleaning roller 270, that is, to purposely reduce performance such as suppression of passage of impurities WM.

Figure 7:
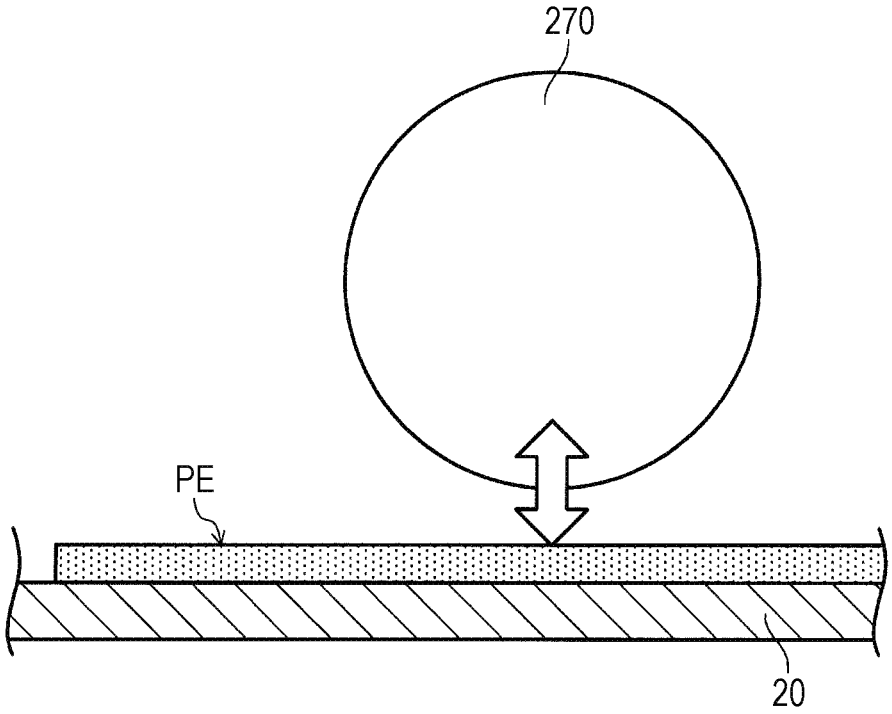
FIG. 7 is a diagram for explaining an example of enabling the cleaning roller to be in and out of contact with a transfer belt.
Figure 8:
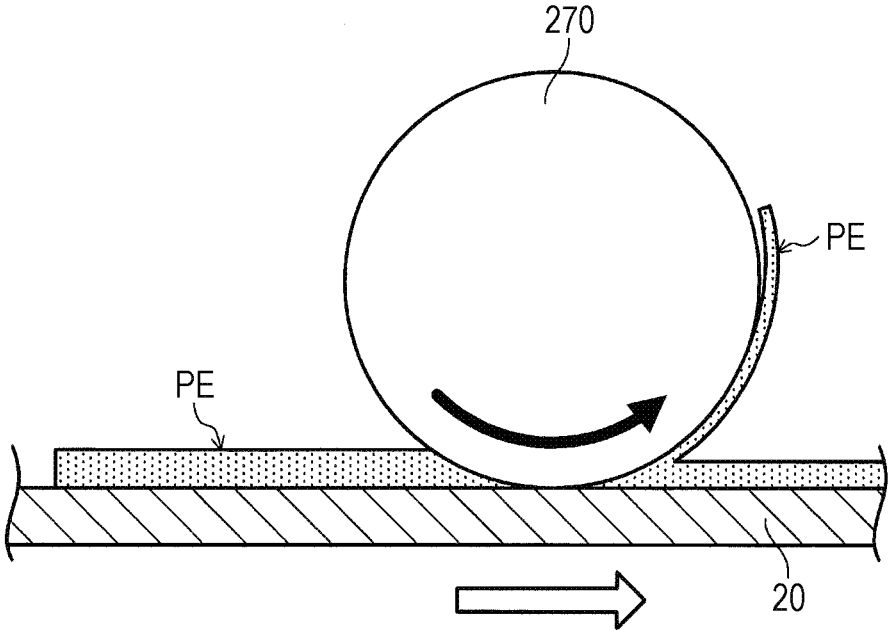
FIG. 8 is a diagram for explaining an example of controlling the cleaning roller to be driven and rotated by a transfer belt.

The control to lower the cleaning performance includes control to separate the cleaning roller 270 from the transfer belt 20 as shown in FIG. 7. Alternatively, as shown in FIG. 8, control to rotate the cleaning roller 270 following the transfer belt 20 (i.e., rotationally drive the cleaning roller 270 in the width direction) is included. Besides those, processing of decreasing the rotational speed of the cleaning roller 270 may be performed by reducing the power supplied to the driving source of the cleaning roller 270, or the like. These configurations and the processings can be combined as appropriate.

To control to separate the cleaning roller 270 from the transfer belt 20, for example, the configuration may be such that a separation mechanism having a driving source such as a solenoid (not shown) is provided on a frame supporting a shaft 270*a* of the cleaning roller 270 (see FIG. 9), and the operation of the separation mechanism is controlled by the controller 40. In this case, the controller 40 outputs a control signal to the solenoid or the like and moves the shaft 270*a* of the cleaning roller 270 in the lower left direction or the upper right direction in FIG. 1 to separate or bring the cleaning roller 270 into contact with the transfer belt 20.

Next, a suitable position for installing the cleaning roller 270 will be described. In the present embodiment, as shown in FIG. 9, the cleaning roller 270 is disposed such that a contact point CP between the transfer belt 20 and the cleaning roller 270 is at a position higher than the rotational center point, that is, the shaft 270*a* of the cleaning roller 270.

More specifically, in the present embodiment, the cleaning roller 270 is disposed at a position where the cleaning roller 270 contacts the lower surface of the transfer belt 20 (see FIG. 1 and the like) and the shaft 270*a* of the cleaning roller 270 is positioned lower than the contact point CP (contact position).

Figure 9:
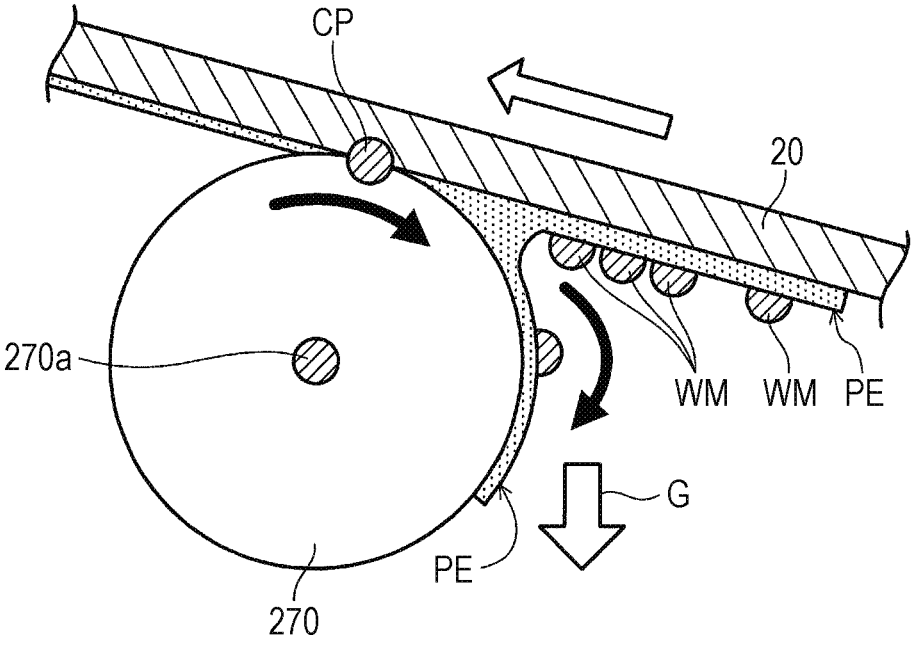
FIG. 9 is a diagram for explaining a position where the cleaning roller is installed.

With such disposition, as shown in FIG. 9, the pre-coating agent PE in a liquid state and the impurities WM such as residual ink fall in the direction of gravity indicated by the arrow G and thus are more easily removed. In other words, the pre-coating agent PE is preferably in a liquid state at least at the time of this cleaning.

Further, by setting the surface energy of the cleaning roller 270 to be greater than the surface energy of the transfer belt 20, the cleanability by the cleaning roller 270 can be further enhanced. In other words, it is more preferable that the surface of the cleaning roller 270 be more easily wetted (have higher wettability) than the surface of the transfer belt 20.

Herein, FIG. 10 shows a table showing materials used for the surface of the cleaning roller 270 or the base material of the transfer belt 20 and comparing the surface energies of those materials.

In FIG. 10, the materials are listed in descending order of surface energy (mN/m). Therefore, the magnitude relationship of values of levels of the surface energies is copper>stainless steel>aluminum>PI>PET>PP>PFA.

For example, when the material of the surface of the transfer belt 20 is polyimide (PI) resin, the surface of the cleaning roller 270 should be made of a material (e.g., aluminum) having a higher surface energy (mN/m). By selecting such a material, the cleanability (the performance to suppress passage of the impurities WM) by the cleaning roller 270 can be further improved.

The values of the surface energy (mN/m) shown in FIG. 10 are basically the results obtained by the inventors measuring at room temperature, and the same applies to an example in FIG. 11 described later. Specifically, the contact angles when the pre-coating agent PE has dropped on the cleaning roller 270 (or the transfer belt 20) made of the materials in FIG. 10 were measured, and the measured contact angles were estimated by Zisman plot and substituted for the values of the surface energies.

Note that the material list shown in FIG. 10 is an example, and various other materials can be used as the material of the surface of the cleaning roller 270. Moreover, the cleaning roller 270 may have a hollow structure or may have a structure in which the surface of the elastic layer of silicone rubber or the like is coated with resin or the like.

Furthermore, the inventors measured the values of the surface energies of various pre-coating agents PE by the following measurement method. The measurement results are shown in the table of FIG. 11 with the types of the pre-coating agent PE and the value of their surface energies.

The inventors measured the values of the surface energies of various pre-coating agents PE shown in FIG. 11 by using a surface tension measurement instrument based on a bubble pressure method or the like.

Herein, the "polyethylene glycol" used was PEG-200 manufactured by Sanyo Chemical Industries, Ltd. In addition, the "liquid paraffin" used was HICALL K-290 manufactured by Kaneda Co., Ltd. The "silicone oil" used was KF-96 manufactured by Shin-Etsu Chemical Co., Ltd. Moreover, for comparison and reference, the value of the surface energy of olive oil (olive oil manufactured by FUJIFILM Wako Pure Chemical Corporation) was also measured.

Note that, in FIG. 11, the surface energies (mN/m) are listed in descending order, and the olive oil for comparison and reference is at the bottom. The liquid paraffin was not used in the experiments described below, but almost the same value of the surface energy of olive oil was measured as shown in the drawing.

Furthermore, the inventors conducted experiments of Examples 1 to 4 and Comparative Examples 1 and 2 described below in order to carry out additional tests for the embodiment described above. Conditions such as procedures commonly used in each experiment are as follows.

(Common Conditions)

The transfer belt 20, which was in a state after the pre-coating agent PE had been applied to the transfer belt 20 and the ink had been emitted and transferred onto the recording medium P, was cleaned by the cleaning roller 270, and the surface state of the transfer belt 20 after the cleaning (hereinafter, referred to as a sample) was inspected.

For this inspection, the sample after the cleaning was observed, and the cleaning performance of the cleaning roller 270 in each experiment was evaluated based on the following evaluation criteria.

No residual ink by visual inspection (99% or more of the impurities removed): ⊙

Small amount of residual ink by visual inspection (90 to 98% of the impurities removed): ○

Intermediate amount of residual ink by visual inspection (50 to 89% of the impurities removed): Δ

Large amount of residual ink by visual inspection (less than 49% of the impurities removed): x Note that, as described in the aforementioned embodiment, the transfer belt 20 having a structure in which the elastic layer and the surface layer are laminated on the base material is usually used, but the transfer belt 20 was in a form of only the base material in these experiments.

The setting conditions for each (individual) experiment in each experiment are as follows.

EXAMPLE 1

The recording medium P (paper type) was high-quality paper. The pre-coating agent PE was polyethylene glycol (PEG-200). The base material of the transfer belt 20 was polyimide (PI) resin. The surface material of the cleaning roller 270 was polyethylene terephthalate (PET) resin. Then, the cleaning roller 270 was rotated in the counter direction, and the rotational speed ratio of the cleaning roller 270 to the transfer belt 20 was set to be constant (θ) to inspect the cleaning performance.

Note that the experiment was conducted in Example 1 in which the surface energy of the transfer belt 20 was greater than that of the cleaning roller 270 (the wettability was high) because the surface energy of PI is greater than that of PET as described with FIG. 10.

EXAMPLE 2

Example 2 was different from Example 1 in that aluminum having higher wettability than PET was used as the surface material of the cleaning roller 270, and the experiment was conducted under the same conditions as Example 1 except for the above.

EXAMPLE 3

The experiment was conducted under the same conditions as in Example 1 except that a PET resin sheet was used as the recording medium P (paper type), silicone oil was used as the pre-coating agent PE, and polypropylene (PP) resin was used as the base material of the transfer belt 20.

Note that the PET resin sheet has poor absorbency for liquids including the pre-coating agent PE and the like as compared with high-quality paper.

EXAMPLE 4

The experiment was conducted under the same conditions as in Example 3 except that the rotational speed of the cleaning roller 270 was slightly increased, and the rotational speed ratio of the cleaning roller 270 to the transfer belt 20 was set a value of 0' (>θ) greater than the above θ.

COMPARATIVE EXAMPLE 1

The experiment was conducted under the same conditions as in Example 2 except that the pre-coating agent PE was not used.

COMPARATIVE EXAMPLE 2

The experiment was conducted under the same conditions as in Example 2 except that the rotational direction of the cleaning roller 270 was set to the same direction as the feeding direction (width) of the transfer belt 20.

Referring to FIG. 12 for the above results, all the results in Examples 1 to 4 were "○" or better (i.e., ⊙ or ○), and 90% or more of the impurities adhered on the transfer belt 20 could be removed. According to these experiments, it was confirmed that, by using the configuration or the method of the present embodiment described above, the impurities adhered to the transfer belt 20 (transfer body), which is a member to be cleaned, were effectively removed, and the cleaning performance was improved.

In addition, comparing the result of Example 1 (○) and the result of Example 2 (⊙), it was confirmed that the cleaning performance was further improved when the material of the surface of the cleaning roller 270 had better wettability (in this example, aluminum).

Herein, referring to FIG. 10 for PET and aluminum, it can be seen that the value of the surface energy (mN/m) of aluminum is greater than that of PET (18 times greater than that of PET). That is, it was confirmed that, as the surface energy (mN/m) of the surface material of the cleaning roller 270 increased, a liquid including the pre-coating agent PE or the like comes into contact with a larger area and easily adheres at the time of cleaning.

Moreover, comparing the result (○) of Example 3 and the result (⊙) of Example 4, it can be seen that better cleaning performance can be obtained by increasing the rotational speed of the cleaning roller 270 when the paper type of the recording medium P is a low absorbent PET sheet. From these experiments, it was confirmed that the cleaning performance could be further improved by controlling the rotational speed of the cleaning roller 270 depending on the paper type.

On the other hand, in Comparative Example 1, due to the fact that the pre-coating agent PE was not supplied to the surface of the transfer belt 20, the impurities entered the cleaning nip with the cleaning roller 270, and residual ink adhered to the surface of the transfer belt 20. As a result, in Comparative Example 1, it was confirmed that the surface of the transfer belt 20 could not be cleaned well although the material of the cleaning roller 270 had high wettability as in Example 2, and the cleaning roller 270 was used by being rotated in the counter direction.

Moreover, in Comparative Example 2, it was confirmed that the impurities entered the cleaning nip because the rotational direction of the cleaning roller 270 was width although the same pre-coating agent PE and cleaning roller 270 as in Example 2 were used. Furthermore, it was confirmed that the impurities mixed in the pre-coating agent PE cannot be cleaned because the amount of pre-coating agent PE left on the surface of the transfer belt 20 increases due to the occurrence of the aforementioned "parting" phenomenon of the pre-coating agent PE even if the wettability of the surface of the cleaning roller 270 was good.

As described above in detail, according to the present embodiment, it is possible to improve the performance of removing the impurities WM adhered to the transfer belt 20 (transfer body).

Although embodiments of the present invention have been described and illustrated in detail, the disclosed embodiments are made for purposes of illustration and example only and not limitation. That is, the present invention can be carried out in various forms without departing from the gist or the main features thereof. The scope of the present invention should be interpreted by terms of the appended claims.

What is claimed is:

1. A cleaning apparatus comprising:

a cleaning rotor that contacts a transfer body and rotates in a counter direction opposite to a moving direction of the transfer body to remove a pre-coating agent and an impurity present on the transfer body after transfer; and a hardware processor that controls a rotational speed of the cleaning rotor;

wherein the cleaning apparatus is configured to carry ink ejected from an inkjet head and to clean the transfer body that transfers the ink onto a recording medium at a transfer nip; and wherein the hardware processor changes the rotational speed of the cleaning rotor in accordance with absorbability of the pre-coating agent in the recording medium.

2. The cleaning apparatus according to claim 1, wherein the hardware processor increases the rotational speed of the cleaning rotor when the absorbability of the pre-coating agent is low as compared with when the absorbability of the pre-coating agent is high.

3. The cleaning apparatus according to claim 1, wherein surface energy of the pre-coating agent is greater than surface energy of the ink.

4. The cleaning apparatus according to claim 1, wherein the cleaning rotor removes the pre-coating agent in a liquid state.

5. The cleaning apparatus according to claim 1, wherein surface energy of the cleaning rotor is greater than surface energy of the transfer body.

6. The cleaning apparatus according to claim 1, further comprising a removing member that removes the pre-coating agent and the impurity adhered to the cleaning rotor from the transfer body by removal with the cleaning rotor.

7. The cleaning apparatus according to claim 1, wherein the hardware processor reduces cleaning performance of the cleaning rotor when the ink is not transferred onto the recording medium as compared with when the ink is transferred onto the recording medium.

8. The cleaning apparatus according to claim 7, wherein the hardware processor reduces the cleaning performance of the cleaning rotor by separating the cleaning rotor from the transfer body.

9. The cleaning apparatus according to claim 7, wherein the hardware processor reduces the cleaning performance of the cleaning rotor by driving the cleaning rotor following movement of the transfer body.

10. The cleaning apparatus according to claim 9, wherein a position of a rotational shaft of the cleaning rotor is below a contact position between the cleaning rotor and the transfer body.

11. The cleaning apparatus according to claim 7, wherein the hardware processor reduces the cleaning performance of the cleaning rotor by decreasing the rotational speed of the cleaning rotor.

12. An inkjet image forming apparatus comprising:

a pre-coating agent supplier that supplies the pre-coating agent to the transfer body;

an inkjet head that is disposed downstream of the pre-coating agent supplier in a moving direction of the transfer body and ejects the ink onto the transfer body; and the cleaning apparatus described in claim 1 that is disposed somewhere from a downstream of the inkjet head to an upstream of the pre-coating agent supplier in the moving direction.

13. A cleaning method for cleaning a transfer body that carries ink ejected from an inkjet head and transfers the ink onto a recording medium at a transfer nip, the cleaning method comprising:

rotating a cleaning rotor, which is in contact with the transfer body, in a counter direction opposite to a moving direction of the transfer body to remove a pre-coating agent and an impurity present on the transfer body after transfer; and changing the rotational speed of the cleaning rotor in accordance with absorbability of the pre-coating agent in the recording medium.

* * * * *